United States Patent [19]

Stenne

[11] 4,453,862

[45] Jun. 12, 1984

[54] METHOD FOR ENSURING MECHANICAL CONTINUITY BETWEEN TWO ADJACENT PANELS OF A REINFORCED CONCRETE WALL CAST IN THE GROUND

[75] Inventor: Roland A. C. Stenne, Ville D'Avray, France

[73] Assignee: Sondages Injections Forages "S.I.F." Enterprise Bachy, Paris, France

[21] Appl. No.: 378,328

[22] Filed: May 14, 1982

[30] Foreign Application Priority Data

May 22, 1981 [FR] France ..... 81 10223

[51] Int. Cl.[3] ..... E02D 5/18; E04B 1/16; E04G 21/00

[52] U.S. Cl. ..... 405/267; 52/743; 264/33

[58] Field of Search ..... 405/267, 275, 287; 52/741–743; 264/33

[56] References Cited

U.S. PATENT DOCUMENTS

| | | | |
|---|---|---|---|
| 3,214,919 | 11/1965 | Kusatake | 405/275 |
| 3,422,627 | 1/1969 | Courte | 405/267 |
| 3,798,914 | 3/1974 | Irwin-Childs | 405/267 |
| 3,893,302 | 7/1975 | Peterson | 405/267 |

FOREIGN PATENT DOCUMENTS

| | | | |
|---|---|---|---|
| 55-39548 | 3/1980 | Japan | 405/267 |

*Primary Examiner*—Cornelius J. Husar
*Assistant Examiner*—Nancy J. Stodola
*Attorney, Agent, or Firm*—Gordon W. Hueschen

[57] ABSTRACT

The invention relates to a method for providing mechanical continuity and the transmission of stresses between two adjacent panels of a reinforced concrete wall cast in the ground, which is characterized by the use of a plurality of jacks the bodies of which are embedded in the concrete of a panel n and the stems are embedded in the concrete of the panel n+1. The invention is useful in the field of civil engineering constructional work.

7 Claims, 7 Drawing Figures

Figures 1A, 1B, 1C, 1D, 1E:
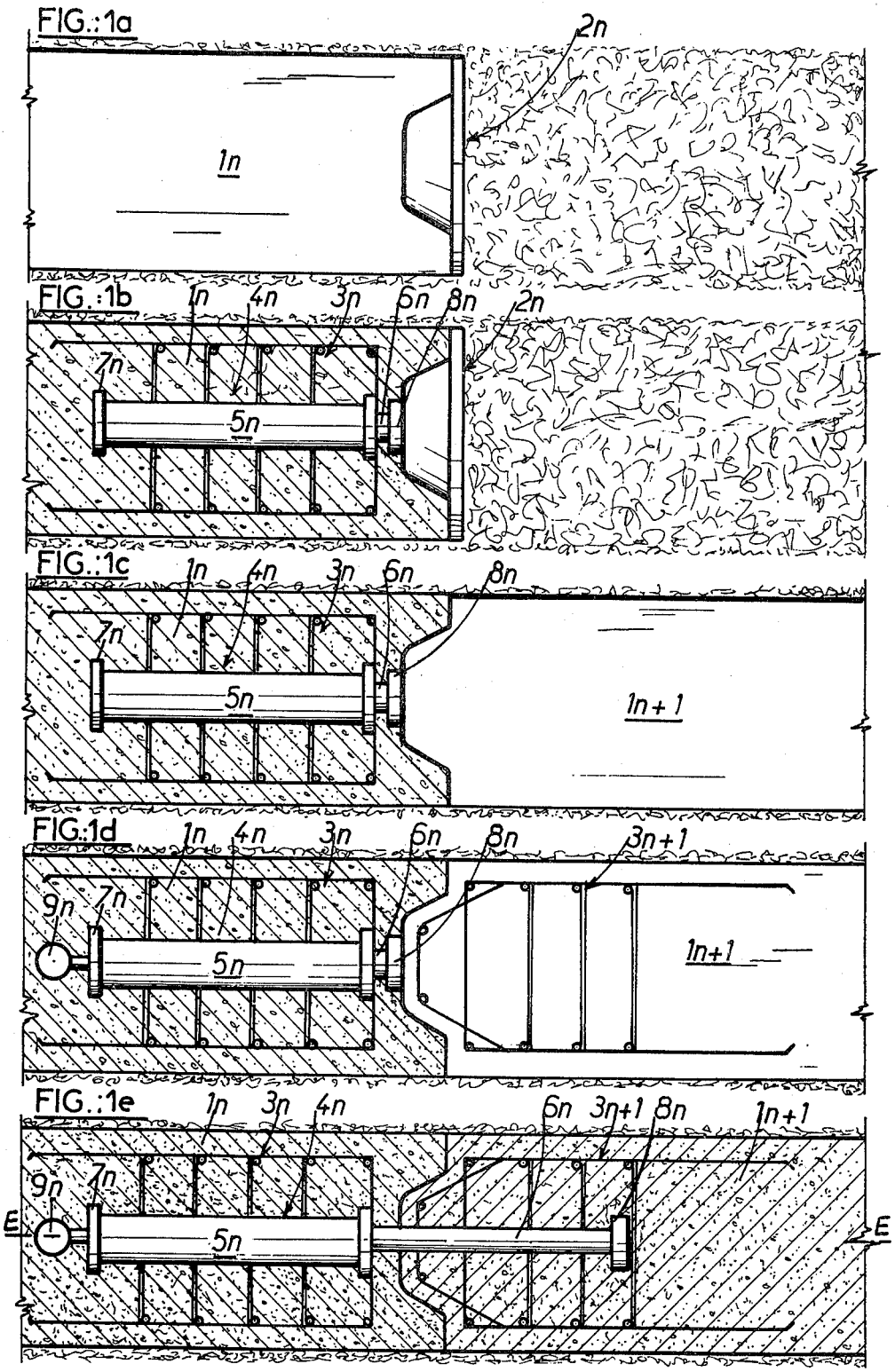

2n
1n 1n
4n
3n
6n
8n
2n
7n
5n 1n
4n
3n
6n
8n
7n
5n
1n+1

1n
4n
3n
6n
8n
3n+1
9n
7n
5n
1n+1

1n
3n
4n
6n
3n+1
8n
1n+1
9n
7n
E
5n
E

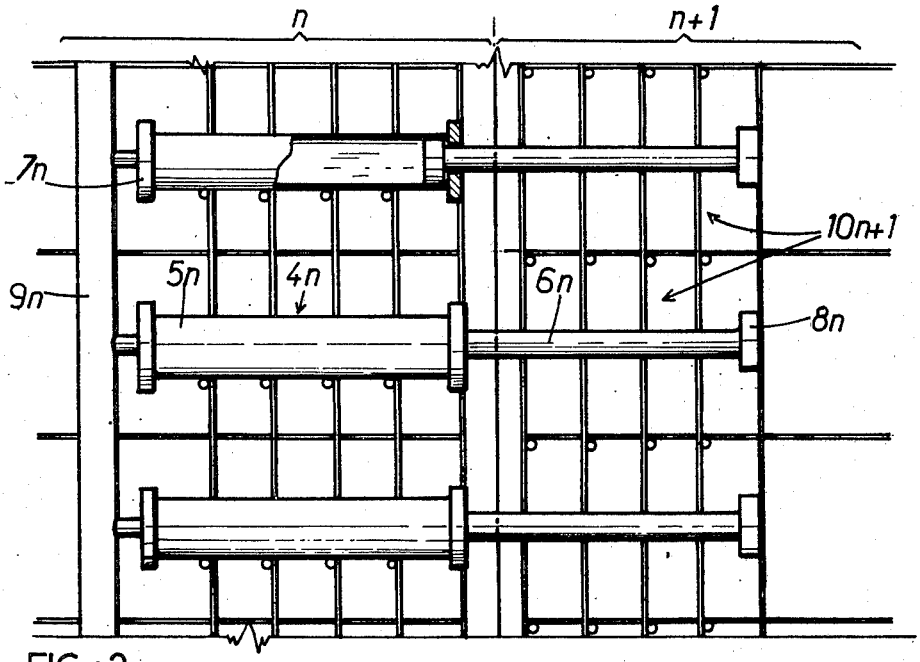
FIG.: 2
FIG.: 3
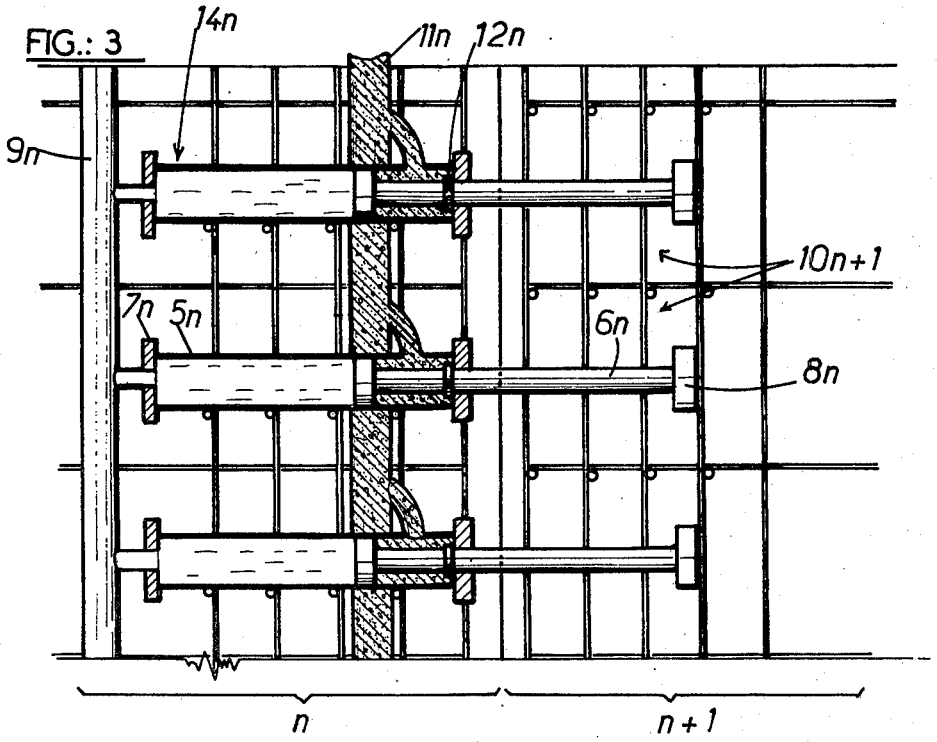

METHOD FOR ENSURING MECHANICAL CONTINUITY BETWEEN TWO ADJACENT PANELS OF A REINFORCED CONCRETE WALL CAST IN THE GROUND

The invention concerns civil engineering techniques and more particularly relates to a process for ensuring mechanical continuity and the transmission of stresses between two adjacent panels of a reinforced concrete wall cast on the ground.

The various methods which have been studied to date are based on the principle of transmitting the stresses in the concrete by overlapping the horizontal reinforcing rods at the ends of the reinforcing cages of adjacent panels. In order to do this, the end of the cage of a first panel is not concreted as the result of a partitioning system having been fitted in place which separates the concreted part of the panel from a space which is left free and which is subsequently brought into communication with the excavation for a second neighbouring panel, so that the cage for the second panel can be fitted in position so that there is overlapping between it and the cage of the first panel thus providing continuity between the two panels prior to pouring of the concrete.

The continuity between the panels established in this way is of the same type as in the case of the restarting of the concreting of a traditional continuous concrete wall, the difficulty consisting in providing a formwork which allows the passage of the reinforcing rods under the conditions prevailing during the construction of a cast wall, i.e. working in an excavation of several meters deep and in the presence of bentonite mud filling said excavation.

Apart from the complicated nature of the formwork which is necessary for providing this continuity of the reinforcing rods and the difficulties in carrying out the process which, in addition to increasing the cost of the actual operation, cause the rate at which the structure is produced to be slowed down when compared to the case of a conventional wall, these methods suffer from two serious disadvantages inherent in the very concept of using an overlapping joint for the reinforcing rods. These are:

the lengths over which the horizontal rods overlap are limited by the dimensions of the system used and are not, generally, adequate if it is desired to make use of rods having interesting diameters; strict adherence to the rules covering reinforced concrete would cause these systems to be overdimensioned to such an extent that most of their interest would be lost;

this method, by virtue of its very nature, does not allow the positioning of transverse connecting rods at the region where the horizontal rods overlap, as would be required by the rules applying to reinforced concrete.

Additionally, the use of a partitioning system together with the sealing means which are involved, leads to an appreciable increase in cost of the system and, additionally, constitutes a disadvantage from the practical point of view, by virtue of the amount of space which such systems occupy.

These previous methods designed to provide transmission of forces between two adjacent panels of a cast wall in which continuity of the horizontal reinforcing rods is obtained using an arrangement based on conventional techniques and which is well known in the field of reinforced concrete using overlapping of the reinforcing rods, consequently does not provide a completely satisfactory solution to the problem which is present here, both from the point of view of adhering to the rules covering reinforced concrete structures and from the point of view of cost and the actual practical arrangement of the system.

The invention has the aim of providing a novel method for ensuring mechanical continuity and the transmission of stresses between two adjacent panels of a reinforced concrete wall, which is cast into the ground, which does not suffer from the disadvantages referred to above and constitutes an appreciable advancement in the state of the art.

In accordance with the invention, this method consists in embedding the bodies of a plurality of jacks into the concrete of a panel n which is being formed, the jacks being arranged at intevals over the height of the panel and being arranged at the end of said panel adjacent to the next panel, n+1, which is to be formed, the stems of the jacks being in the retracted position and their ends being arranged in the immediate vicinity of the formwork means provided at the end of the excavation in which the panel n is cast, then, ater the concrete of this panel has set to a sufficient extent, carrying out excavation for the next panel, n+1, and removing the formwork means provided at the end of the excavation for the panel n, causing the stems of the jacks to be extended so that they penetrate into the excavation for the next panel, n+1, to be formed and, finally, in concreting the excavation for said panel n+1 thus embedding the stems of the jack in the concrete.

After the concrete has hardened, the jacks with their extended stems perform the function of reinforcing rods and thus ensure transmission of stresses from one panel to the next one.

In order to obtain the best possible anchoring of the jacks into the concrete, it is advantageous to provide the bodies of the jacks and their stems, at their opposing ends, with end plates or flanges. As a variation in this, the body of the jack could be provided with protuberances designed to improve the adhesion between the concrete and the body of the jack, in which case only the stem would be provided with a flange or anchoring plate at its free end. In accordance with yet a further variant, the body of the jack could be fixed to reinforcing rods or anchoring rods which will be themselves embedded in the concrete.

As the reinforcing cages will most frequently be inserted into the excavations prior to pouring of the concrete, it will be appropriate to attach the bodies of the jacks to the reinforcing cage, or suspend them therefrom, in order to arrange for their distribution over the height of the panel which is to be formed. If the attachment of the body to one of the rods of the cage is sufficiently rigid, one could use this arrangement for anchoring the body to the concrete before the latter is cast, without it being necessary to provide a lange or endplate on the body of the jack.

Clearly, where reinforcement cages are used, it will be necessary to provide free areas inside these which are adapted to receive the stems of the jacks when the latter are extended.

Thus, each reinforcing cage may carry a series of jacks at one of its ends and be provided with free spaces of adequate size at its other end for receiving the stems of the jacks of the adjacent reinforcing cage, when these are extended. As a variation to this, every second reinforcing cage may carry a set of jacks at each of its ends, the adjacent cages being, where they face each other, provided with free regions of adequate volume. In this latter embodiment, the jacks provided at the two ends of the cages which are carrying the jacks can be linked pairwise by a linking body, such as a steel bar, in order to provide for their anchoring.

Concerning the jacks which can be used, it is possible to employ single or double-acting jacks. In the case of single-acting jacks, it will be necessary to take care that, when the stems are extended which is done, for example, using compressed air or another fluid under pressure, the piston of each jack comes effectively into contact with the base of the cylinder in order to be sure that the stresses will be correctly transmitted from the stem to the body of the jack, and vice-versa. In the case of double-acting jacks, it will be appropriate to carry out pre-stressing, after the concrete has set, in order to place the stem of the jack under traction. In order to ensure that this pre-stressing force remains constant with the passage of time, a hardenable fluid is used for the fluid used to put the jack under pressure, this for example, being a non-shrink cement grout, which will set in the cylinder of the jack. Such a hardenable fluid could additionally be used in the case where a single-acting jack is employed.

The areas where the body and the stem of the jack are anchored may be reinforced in the transverse sense using reinforcing rods provided for this purpose in the reinforcing cages, so that the conventional practices for reinforced concrete can be adhered to.

The jacks may be of ordinary standard quality, or even of sub-standard quality, in view of the fact that they are only designed to operate once.

The jacks can be located horizontal and parallel to the faces of the cast wall or arranged to lie in any other desired direction needed for the task of transmitting stresses. The jacks can be positioned in the mean plane of the panels if the need is to transmit a simple pull. Where it is necessary to transmit bending stresses, a series of jacks can be provided which are offset with respect to the mean plane of the panels when the stress always applies in the same sense, or two series of jacks which are each positioned on opposite sides of the mean plane of the panels when the stresses acting on the wall apply in an alternating fashion in the two senses.

The stems of the jacks are advantageously protected from corrosion over the area where they perform the joint. In order to do this, one could, for example, provide an anti-corrosive coating on the stem of each jack.

The size of the jacks will depend, obviously, on the forces to which they will be subject.

The description which follows in conjunction with the attached drawing, which is provided solely by way of non-limiting example, will lead to a ready understanding of how the invention can be carried out in practice.

FIGS. 1*a* to 1*e* are diagrammatical plan views illustrating the process in accordance with the invention.

FIG. 2 is a diagrammatical view in cross-section along the line E—E in FIG. 1*e*; and FIG. 3 is a diagrammatical view illustrating one variation in the method according to the invention.

With reference now to the drawings, FIGS. 1*a* to 1*e* and 2 illustrate how the method in accordance with the invention is carried out. In FIG. 1*a*, an excavation 1*n* will be seen which has been formed in the conventional manner using a bentonite slurry, into which the panel n of the cast wall will be formed by a pouring operation. At the end of this excavation and adjacent to the next panel n+1, a shaped formwork 2*n* is inserted. A reinforcing cage 3*n* (which is shown in a very simplified fashion) is inserted into the excavation 1*n* and a series of jacks 4*n*, of the single-acting type and in their withdrawn position, are attached to the latter.

The jacks 4*n* consist of a body 5*n* and a stem 6*n* carrying flanges or anchoring plates, at their opposing ends. Such plates are shown at 7*n* and one end of the cylinders or bodies 5*n* and at 8*n* at the opposite end on stem 6*n*. The plates 7*n* extend beyond the walls of the cylinders or bodies 5*n* and the plates 8*n* extend beyond the stem 6*n*, thereby forming protuberances which function to anchor the jacks 4*n* and the stems 6*n* in the concrete. Plates corresponding to plates 7*n* are also shown at the opposite ends of the cylinders or bodies 5*n*. The jacks 4*n* are positioned at intervals, for example at regular intervals over the height of the cage and in the region of the cage which adjoins the formwork 2*n*. The cylinders or bodies 5*n* of the jacks 4*n*, which are fixed to rods of the reinforcing cage 3*n*, are supplied with fluid under pressure through a conduit 9*n*. Once the cage carrying the jacks is in place, a short blast of compressed air is fed into the jacks to cause the plates 8*n* to come into abutment with the formwork 2*n*, and after this the concrete is poured into the excavation 1*n* (FIG. 1*b*).

During this concreting operation, the cage 3*n*, the conduit 9*n*, the bodies 5*n* of the jacks and their plates 7*n* become embedded in the concrete, whilst only a small portion of the stems 6*n* becomes surrounded by concrete, the plates 8*n* being flush with the end of the concreted area.

After this, an excavation $\mathbf{1}_{n+1}$ is dug so as to follow the excavation 1*n*, and into this, the panel n+1 will be cast. Following this, the formwork 2*n* (FIG. 1*c*) is removed; alternatively, the formwork could be removed prior to the digging of the excavation $\mathbf{1}_{n+1}$, provided that the concrete of panel n has become sufficiently solid to be self-supporting.

In the following step (1*d*), a reinforcing cage $\mathbf{3}_{n+1}$ is fitted into place in the excavation $\mathbf{1}_{n+1}$, and this is similar to the cage 3*n* and in which the end closest to the panel n is provided with free areas $\mathbf{10}_{n+1}$ corresponding to the space which will be taken up by the stems 6*n* together with their plates 8*n* once these have been extended, whilst its opposing end carries a plurality of jacks $\mathbf{4}_{n+1}$ (which are not shown).

Finally, (FIG. 1*e*), a fluid under pressure is injected into the conduit 9*n* in order to free the stems 6*n* from engagement with the concrete and to extend them up until a point where the portion of each jack comes into abutment, at the end of its travel, with the base of the cylinder of the jack. If it is desired, one could use an injection pipe with a conventional double closure which is inserted into the conduit 9*n* and which would be brought successively to a position corresponding to each one of the branch pipes supplying fluid to the jacks, in order to be certain that the operation of the jacks has actually occured. It should be noted that it is relatively easy to free the stems from their engagement with the concrete, as the latter only surrounds a short smooth portion of each stem if care has been taken to apply the plates 8*n* against the end formwork. After this, all that is required is to pour concrete into the excavation $\mathbf{1}_{n+1}$. Obviously, an identical process to that which has just been described will be used for obtaining the joint between the panels n+1 and n+2.

Due to the presence of the flanges or plates 7*n* and 8*n*, the body and stem of the jacks are rigidly anchored in the concrete, which excludes any possible risk of their sliding.

FIG. 3 shows a variation in the method used in the invention in which double-acting jacks 14 are employed in place of the single-acting jacks 4. In this variant, jacks are used in which the cylinder includes two chambers which can be put under pressure by means of the conduits 9*n* and 11*n* respectively, and one then proceeds as was described with reference to FIGS. 1 and 2 except that, in the sequence illustrated in FIG. 1*e*, the stems are not completely extended but rather, a certain length of residual travel remains, which for example can be obtained using a stop 12*n* on the stem of each jack, and that, after the concrete cast in the excavation n+1 has set, the stem of each one of the jacks is put under traction by injecting a fluid which hardens under pressure into the conduit 11*n*, this for example being a non-shrink cement grout the solidification of which will ensure that a permanent tractional force is applied to the stem of each one of the jacks. FIG. 3 shows the jacks after they have been put under traction.

Obviously, the embodiments described above have only been provided by way of examples and it would be possible to modify these, notably by substituting equivalent technical means, without this leading to departure from the scope of the invention.

I claim:

1. Method for providing mechanical continuity and transmission of stresses between two adjacent panels of a reinforced concrete wall cast into excavations in the ground, which comprises embedding the bodies of a plurality of jacks into the concrete of a panel n which is being formed, the jacks being arranged at intervals over the height of the panel and being arranged at the end of said panel adjacent to the next panel n+1 to be formed, the stems of the jacks being in the retracted position and their ends being arranged in the immediate vicinity of formwork means provided at the end of the excavation in which the panel n is cast, then, after the concrete of this panel has set to a sufficient extent, carrying out excavation for the next panel n+1 and removing formwork means provided at the end of the excavation for the panel n, then causing the stems of the jacks to be extended so that they penetrate into the excavation for the next panel n+1 to be formed and, finally, concreting the excavation for said panel n+1, thus embedding the stems of the jacks in the concrete.

2. Method in accordance with claim 1, wherein the bodies of the jacks are attached to a reinforcing cage which is inserted into the excavation n prior to the pouring of the concrete.

3. Method in accordance with claim 1, wherein jacks are employed of which the body and the stem are provided, at their opposing ends, with flanges or plates.

4. Method in accordance with claim 1, wherein single-acting jacks are used.

5. Method in accordance with claim 1, wherein double-acting jacks are used, and wherein the stems are put under traction after the concrete poured into the excavation n+1 has set, by injecting a hardenable fluid under pressure into the jacks.

6. Method in accordance with claim 1, wherein the bodies of the jacks are provided with protuberances.

7. Method in accordance with claim 1, wherein the bodies of the jacks are fixed to rods which are embedded in the concrete.

* * * * *